US012378828B2

(12) United States Patent
Taggart et al.

(10) Patent No.: US 12,378,828 B2
(45) Date of Patent: Aug. 5, 2025

(54) SLIP APPARATUS AND METHODS OF USING SAME

(71) Applicant: Drillform Technical Services Ltd., Calgary (CA)

(72) Inventors: Mark Charles Taggart, Okotoks (CA); Vladimir Scekic, New Westminster (CA); Todd Harry McCorriston, Calgary (CA)

(73) Assignee: DRILLFORM TECHNICAL SERVICES LTD., Calgary (CA)

( * ) Notice: Subject to any disclaimer, the term of this patent is extended or adjusted under 35 U.S.C. 154(b) by 0 days.

(21) Appl. No.: 17/480,971

(22) Filed: Sep. 21, 2021

(65) Prior Publication Data

US 2022/0090454 A1 Mar. 24, 2022

Related U.S. Application Data

(60) Provisional application No. 63/080,897, filed on Sep. 21, 2020.

(51) Int. Cl.
*E21B 19/10* (2006.01)
*E21B 19/24* (2006.01)

(52) U.S. Cl.
CPC ..... *E21B 19/10* (2013.01); *E21B 19/24* (2013.01)

(58) Field of Classification Search
CPC ..... E21B 19/10; E21B 19/102
See application file for complete search history.

(56) References Cited

U.S. PATENT DOCUMENTS 1,195,906 A * 8/1916 Brown ..... E21B 19/10 188/67
1,543,904 A * 6/1925 Carr ..... E21B 19/10 188/67
1,656,864 A * 1/1928 Martin ..... E21B 19/10 188/67
1,851,009 A * 3/1932 Hoffoss ..... E21B 19/10 188/67
1,883,073 A * 10/1932 Stone ..... E21B 19/10 173/149
2,063,378 A * 12/1936 Hiniker ..... E21B 19/10 188/67
2,068,217 A * 1/1937 Abegg ..... E21B 19/10 188/67
2,127,108 A * 8/1938 Driscoll ..... E21B 19/10 24/DIG. 22
2,245,592 A * 6/1941 Jones, Jr. ..... E21B 19/10 188/67
3,270,389 A * 9/1966 Kingsbury ..... E21B 19/10 188/67

(Continued)

FOREIGN PATENT DOCUMENTS

CA 2465530 3/2004
CA 2679698 9/2008

(Continued)

*Primary Examiner* — Blake Michener
(74) *Attorney, Agent, or Firm* — Sheridan Ross P.C.

(57) ABSTRACT

Embodiments of the present disclosure relate to a slip apparatus and methods of using same. The slips apparatus is configured to grip and hold a portion of a tubular, or a string of tubulars, within a central bore of the slips apparatus so that a tubular can be added or removed from the string of tubulars during drilling or other operations at a well.

11 Claims, 13 Drawing Sheets

(56) References Cited

U.S. PATENT DOCUMENTS

| | | | | |
|---|---|---|---|---|
| 3,507,174 | A | 4/1970 | Dickmann | |
| 3,799,009 | A | 3/1974 | Guier | |
| 3,919,902 | A | 11/1975 | Johnson | |
| 3,961,399 | A | 6/1976 | Boyadjieff | |
| 4,269,277 | A * | 5/1981 | Baugh | E21B 19/10 173/149 |
| 4,295,527 | A | 10/1981 | Ruesse | |
| 4,355,443 | A * | 10/1982 | Blackwell | E21B 19/10 188/67 |
| 4,372,026 | A | 2/1983 | Mosing | |
| 4,389,760 | A * | 6/1983 | Krasnov | E21B 19/10 188/67 |
| 4,688,453 | A | 8/1987 | Schulze-Beckinghausen | |
| 4,765,401 | A | 8/1988 | Boyadjieff | |
| 5,060,542 | A | 10/1991 | Hauk | |
| 5,092,399 | A | 3/1992 | Lang | |
| 5,520,072 | A | 5/1996 | Perry | |
| 6,142,041 | A | 11/2000 | Buck | |
| 6,318,214 | B1 | 11/2001 | Buck | |
| 7,191,686 | B1 | 3/2007 | Angelle et al. | |
| 7,204,173 | B2 | 4/2007 | Buck | |
| 7,707,914 | B2 | 5/2010 | Pietras et al. | |
| 7,861,618 | B2 | 1/2011 | Pietras et al. | |
| 7,926,557 | B2 * | 4/2011 | Huebner | F24F 5/0092 165/53 |
| 7,926,577 | B2 * | 4/2011 | Thomas | E21B 19/10 166/380 |
| 8,020,626 | B2 | 9/2011 | Francis et al. | |
| 8,042,432 | B2 | 10/2011 | Hunter et al. | |
| 8,157,478 | B2 | 4/2012 | Wentworth et al. | |
| 10,309,169 | B2 | 6/2019 | Scekic | |
| 10,538,976 | B2 | 1/2020 | Scekic et al. | |
| 2004/0237726 | A1 | 12/2004 | Schulze-Beckinghausen | |
| 2009/0255662 | A1 | 10/2009 | Ge | |
| 2011/0030512 | A1 | 2/2011 | Begnaud, Jr. | |
| 2012/0323500 | A1 | 12/2012 | Prefontaine | |
| 2015/0082598 | A1 | 3/2015 | Lavalley et al. | |
| 2019/0017336 | A1 | 1/2019 | Saavedra | |
| 2020/0277826 | A1 | 9/2020 | McCorriston et al. | |

FOREIGN PATENT DOCUMENTS

| | | |
|---|---|---|
| CA | 2773295 | 10/2013 |
| CN | 104895515 | 9/2015 |
| CN | 105134108 | 12/2015 |
| EP | 1517000 | 3/2005 |
| EP | 3097250 | 11/2016 |
| GB | 2400389 | 10/2004 |
| GB | 2433954 | 7/2007 |
| WO | WO 2004/025071 | 3/2004 |
| WO | WO 2011/060270 | 5/2011 |
| WO | WO 2014/179862 | 11/2014 |
| WO | WO 2016/183670 | 11/2016 |

* cited by examiner

FIG. 5A
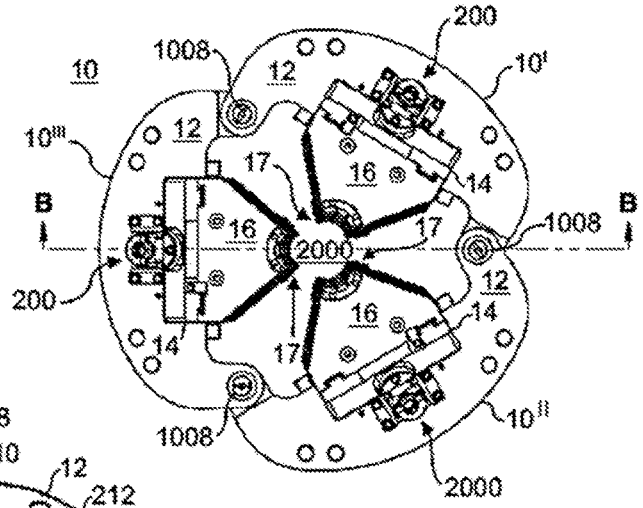
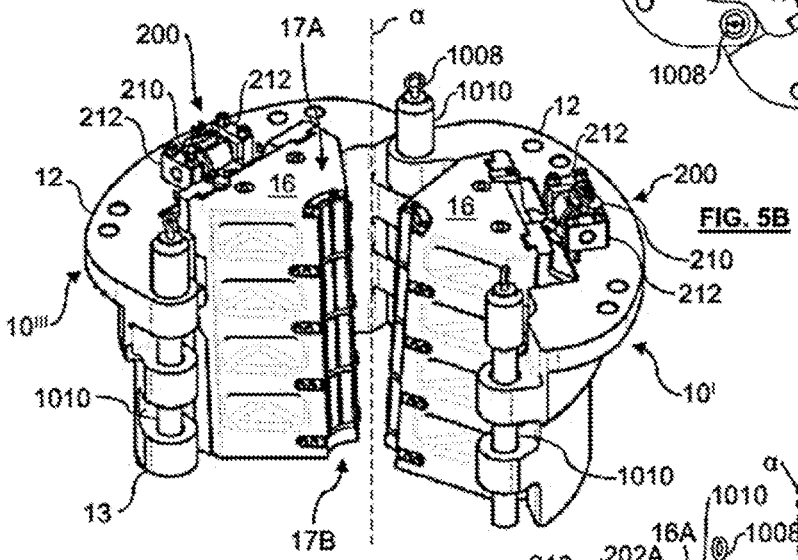
FIG. 5B
FIG. 5C
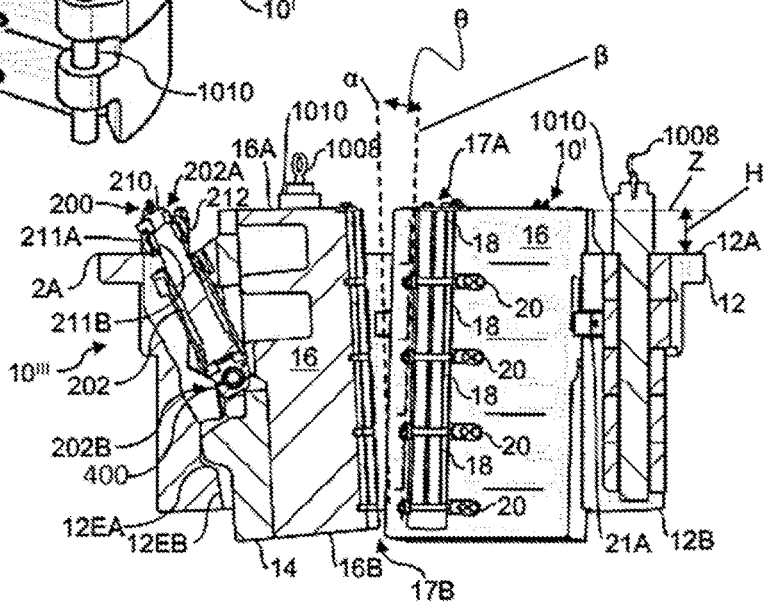

FIG. 8A
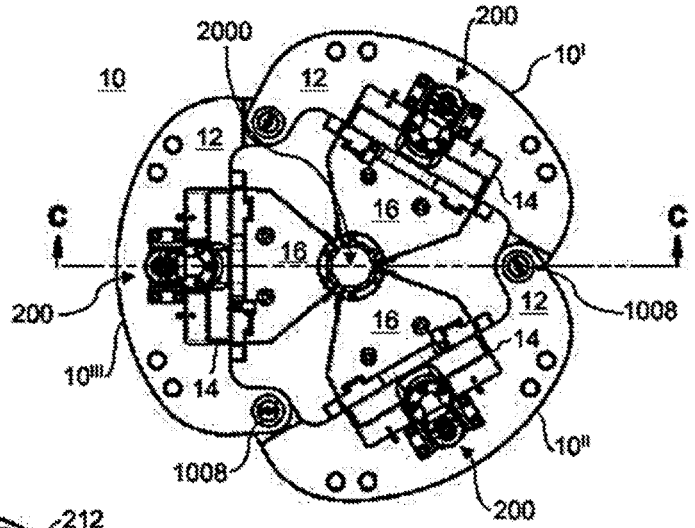
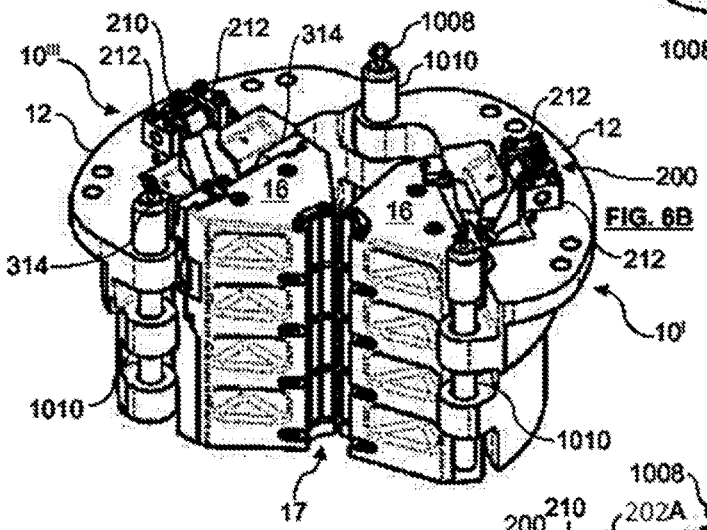
FIG. 8B
FIG. 8C
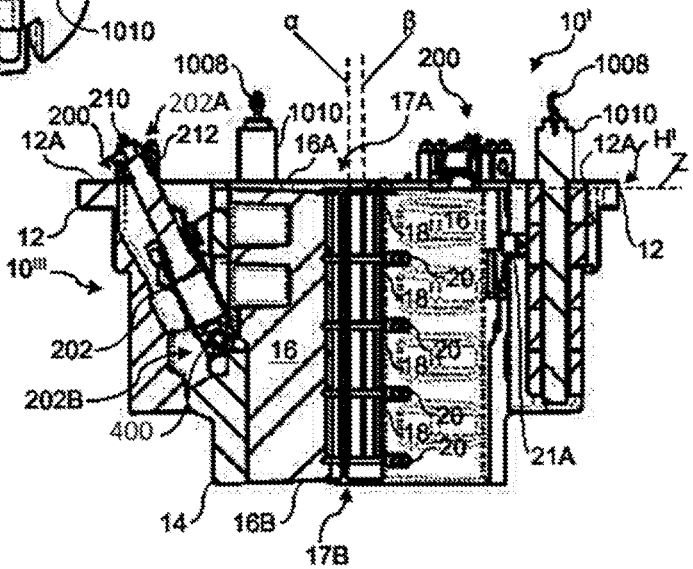

FIG. 7A
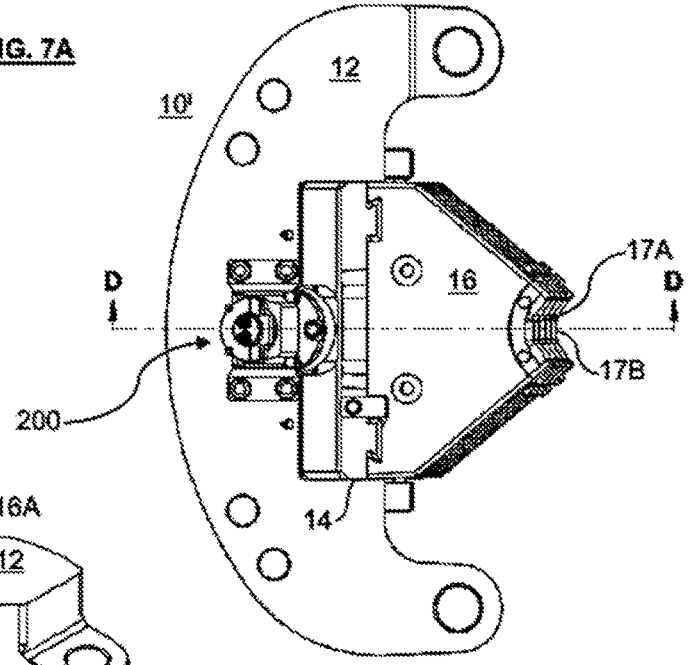
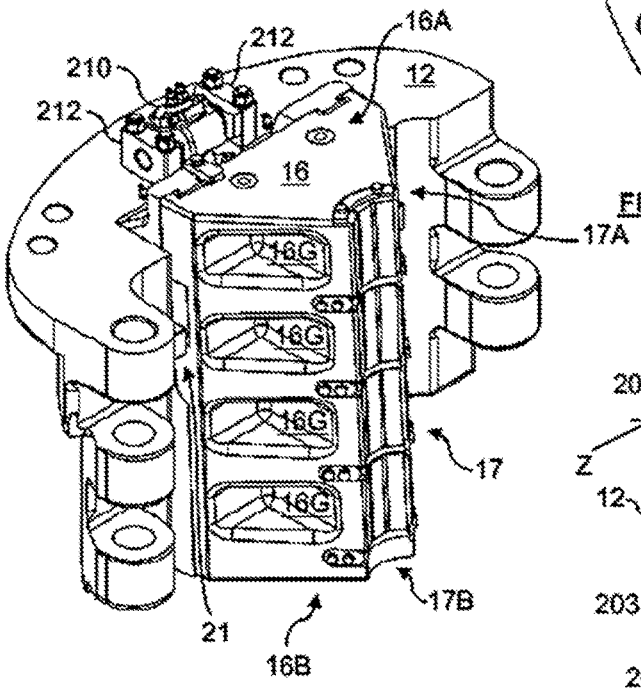
FIG. 7B
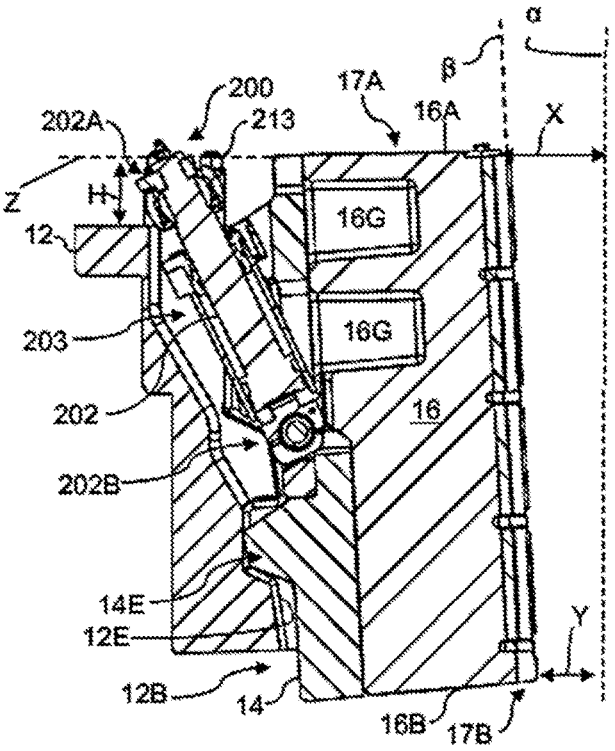
FIG. 7C

FIG. 8A
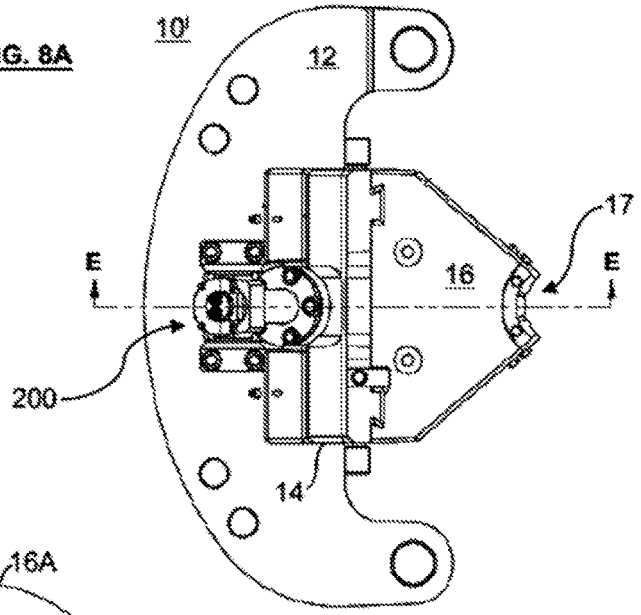
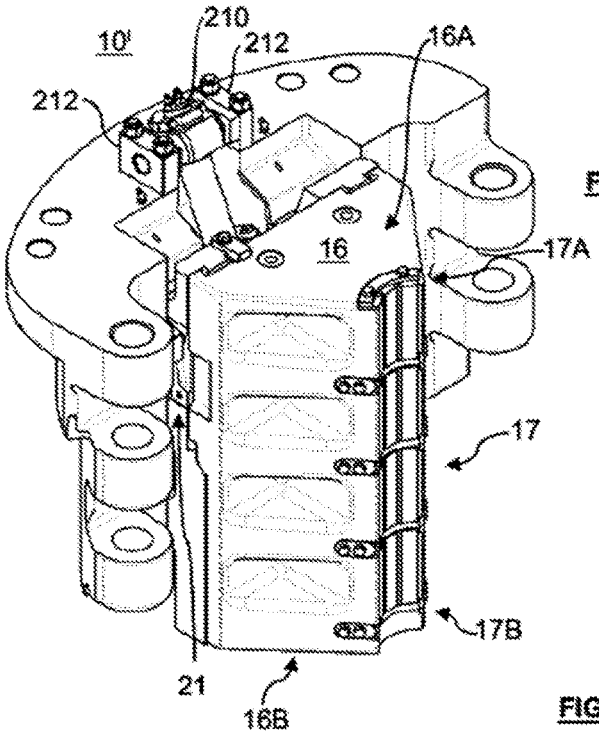
FIG. 8B
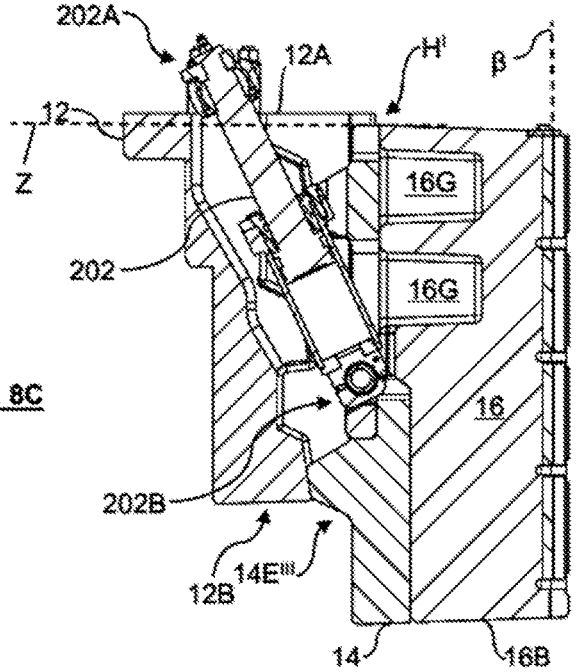
FIG. 8C

SLIP APPARATUS AND METHODS OF USING SAME

CROSS-REFERENCE TO RELATED APPLICATION

This application claims the benefit of priority under 35 U.S.C. § 119(e) to U.S. Provisional Patent Application 63/080,897, filed 21 Sep. 2020, the entirety of which is incorporated herein by reference.

TECHNICAL FIELD

This disclosure generally relates to drilling and completing a well. In particular, the disclosure relates to a slip apparatus and methods for using same in the making and breaking of a string of connected tubulars within the well.

BACKGROUND

Drilling a well for capturing subterranean hydrocarbons involves coupling and decoupling tubulars to make and break down a string of tubulars. In many drilling rigs, a rotary table is used to provide torque to the drilling string as it is being advanced into the well bore and as it is being withdrawn from the wellbore. As an individual tubular is being added or removed from the drill string, the tubing string must be temporarily supported so that further rig components can be used to couple or decouple the next tubular in the string.

Slips are known devices that are used to temporarily support the drill string. Some slips are manually applied and others can have powered actuators to move them between a gripping position and a non-gripping position. In the gripping position, the slips grip the outer surface to support the tubular to which an individual tubular is being coupled or from which an individual tubular is being decoupled. In the non-gripping position, the slips are retracted and sometimes removed to allow the tubing string to be supported by other rig components.

Typically when slips are in the gripping position, the weight of the string of tubulars causes the slips to move downwardly, which increases the gripping force, also referred to herein as a clamping force, applied to the gripped tubular. However, in some instances the weight of the string of tubulars is insufficient to increase the gripping force, which can result in the string of tubulars moving into the well bore below in an undesired fashion.

Furthermore, when known slips are in the non-gripping position there can be incidents where the tubular within the slips is rotating off-center, which can result in the rotating tubular striking the slips causing damage to both the tubular and the slips.

SUMMARY

The embodiments of the present disclosure provide a slip apparatus, which may also be referred to herein as a slips apparatus, that is suitable for use in a rig positioned above a portion of an oil and/or gas well. The rig includes at least a rotary table for imposing rotational forces upon a string of tubulars that are being inserted into or removed from the well below by moving through a central bore that is defined by the slip apparatus. The slip apparatus is useful when the string of tubulars is being extended by coupling of one or more tubulars to the top of the string, above the rotary table. The slips are also useful when a portion of the string of tubulars is being shortened, by decoupling one or more tubulars from the top of the string, above the rotary table.

In some embodiments of the present disclosure, the slip apparatus is connectible with a rotary table, the slips apparatus comprises at least two opposed non-gripping components, each defining an inner surface that define a central bore. The slips apparatus also includes at least two opposed gripping components that each define an outer surface and an inner surface. The outer surfaces are moveable at least partially along the inner surface of an associated non-gripping component between a first position and a second position. The slips apparatus also includes at least two actuator assemblies, each of which is operatively configured to move one of the at least two opposed gripping components between the first position and the second position. In the first position, each of two opposed gripping components is positioned at an oblique angle, also referred to as a non-parallel angle, relative to a central axis of the central bore, and in the second position each of the two opposed gripping components is positioned substantially parallel to the central axis and the at least two opposed gripping components are configured to grip a portion of an outer surface of a tubular that is positioned within the central bore.

In some embodiments of the present disclosure, a method for operating the slips apparatus is provided. The method comprises the steps of: positioning a tubular within a central bore of a slips apparatus along a central axis when at least two opposed gripping components of the slips apparatus are in a first position that is at an oblique angle, also referred to as a non-parallel angle, relative to the central axis; and, actuating the slips apparatus so that at least two opposed gripping components are in a second position that is substantially parallel to the central axis and the at least two opposed gripping components are configured to grip a portion of an outer surface of the tubular.

Without being bound by any particular theory, the slips apparatus comprises one or more actuators that are each configured for moving gripping-components of the slips apparatus between a first position and a second position. The slips apparatus is in the first position when the gripping components are positioned further from a central axis of the slips apparatus than when the gripping components are in the second position and when an upper portion of the gripping components are positioned further away from the central axis than a lower portion of the same gripping components. In some embodiments of the present disclosure, when the slips apparatus is in the first position, the gripping components are raised compared to when the slips apparatus is in the second position. In the first position, the faces of the gripping components are configured to be not parallel to each other and substantially not parallel to the central axis. When the slips apparatus is in the first position, a tubular can move through the central bore defined by slips apparatus, substantially along the central axis. When the slips apparatus is in the second position, the gripping components are configured to connect and grip the outer surface of a tubular within the central bore, thereby supporting the tubular and any string of tubulars below the slips apparatus.

In some embodiments of the present disclosure, the slips apparatus further comprises a positioning assembly positioned between a gripping component and a stationary component. The positioning assembly is configured to facilitate moving the gripping component between the first position and the second position.

As will be appreciated by those skilled in the art, when a tubular that is positioned within a known slips-apparatus it can rotate, generally about the central axis of the known slips-assembly, about a longitudinal axis of the tubular, or about both axes. In some instances, the tubular may rotate about an axis that is neither central axis of the known slips-apparatus nor the longitudinal axis of the tubular. When the tubular is rotating in this fashion, the outer surface of the tubular can strike against gripping components, or other components, of the known slips-apparatus. These strikes can damage the tubular and the slips apparatus thereby increasing the costs associated with monitoring, maintenance and replacement of damaged tubulars and/or components of the known slips-apparatus. In contrast, when the slips apparatus of the present disclosure are used and when the slips apparatus are in the first position this may decrease the instances of strikes between a rotating tubular and the slips apparatus. This can decrease the instances of strikes and increase the operational life of the tubulars and the slips apparatus, as compared to when known slips-apparatus are used.

As will be appreciated by those skilled in the art, known slips-apparatus impart a clamping force on the outer surface of a tubular within the central bore. The amplitude of the clamping force can be increased when the slips apparatus has initially engaged the tubular but then weight of the tubular, or the tubing string therebelow, causes the gripping components to move downwardly and inwardly to further engage and grip the tubular. However, if the tubular, or tubing string, is of an insufficient weight the gripping components of the known slips-apparatus may not fully grip the tubular within the central bore. This may be referred to as being "pipe light" and it can result in the tubular, or tubing string, slipping downwardly into the well below. In some instances of a pipe-light scenario, the tubular may slip and be lost below the slips apparatus, which can cause significant costs in downtime and recovery operations. In contrast, some embodiments of the present disclosure provide a slips apparatus that comprises two or more sections of gripping components and one or more actuator assemblies. Each actuator assembly is configured to move a section of gripping components between the first position and the second position. Without being bound by any particular theory, each actuator assembly can increase a gripping force exerted on the outer surface of the tubular by the gripping components, regardless of the weight of the tubular, or the tubing string. This may reduce the incidence of the tubular slipping and the related costs.

In some embodiments of the present disclosure, the slips apparatus comprises one or more actuator assemblies and each actuator assembly comprises an actuator that is couplable at a first end to a gripping component by a first pivotable connection and at a second end to an associated slip block assembly by a second pivotable connection. In some embodiments of the present disclosure, the first pivotable connection and/or the second pivotable connection each have more than one degree of freedom. In some embodiments of the present disclosure, the second pivotable connection is able to swivel, tilt and or pivot.

In some embodiments of the present disclosure, the actuator assembly generates a moving force that is applied in a first direction upon a substantially flat surface of one or more gripping components. When the moving force is applied in the first direction, the one or more gripping components move from the first position towards the second position. In some embodiments of the present disclosure, the first direction is a substantially straight direction towards or away from a center of the central bore that is defined by the slips apparatus.

In some embodiments of the present disclosure, the slips apparatus comprises a cam assembly that is formed between a first cam feature that is defined upon a non-gripping component and a second cam feature that is defined upon a gripping component. The first cam feature and the second cam feature are configured to mate and form the cam assembly, which is configured to direct movement of the gripping features between the first position and the second position. In some embodiments of the present disclosure, the cam assembly can slidingly guide movement of the gripping components between the first position and the second position.

BRIEF DESCRIPTION OF THE DRAWINGS

These and other features of the present disclosure will become more apparent in the following detailed description in which reference is made to the appended drawings.

FIG. 5A shows a top-plan view of the slips apparatus in the first position.

FIG. 5B shows an isometric view of the slips apparatus in the first position with one section of the slips apparatus not shown.

FIG. 5C shows a cross-sectional view of the slips apparatus in the first position taken through line B-B in FIG. 5A.

FIG. 6A shows a top-plan view of the slips apparatus of FIGS. 5A-C in the second position.

FIG. 6B shows an isometric view of the slips apparatus of FIGS. 5A-C with one section of the slips apparatus not shown.

FIG. 6C shows a cross-sectional view of the slips apparatus of FIGS. 5A-C taken through line C-C in FIG. 6A.

FIG. 7A shows a top-plan view of one section of the slips apparatus of FIGS. 5A-C in the first position.

FIG. 7B shows an isometric view of the section of FIG. 7A in the first position.

FIG. 7C shows a cross-sectional view of the section of FIG. 7A in the first position taken through line D-D in FIG. 7A.

FIG. 8A shows a top-plan view of one section of the slips apparatus of FIGS. 6A-C in the second position.

FIG. 8B shows an isometric view of the section of FIG. 8A in the second position.

FIG. 8C shows a cross-sectional view of the section of FIG. 8A in the second position taken through line E-E in FIG. 8A.

DETAILED DESCRIPTION

Figure 1:
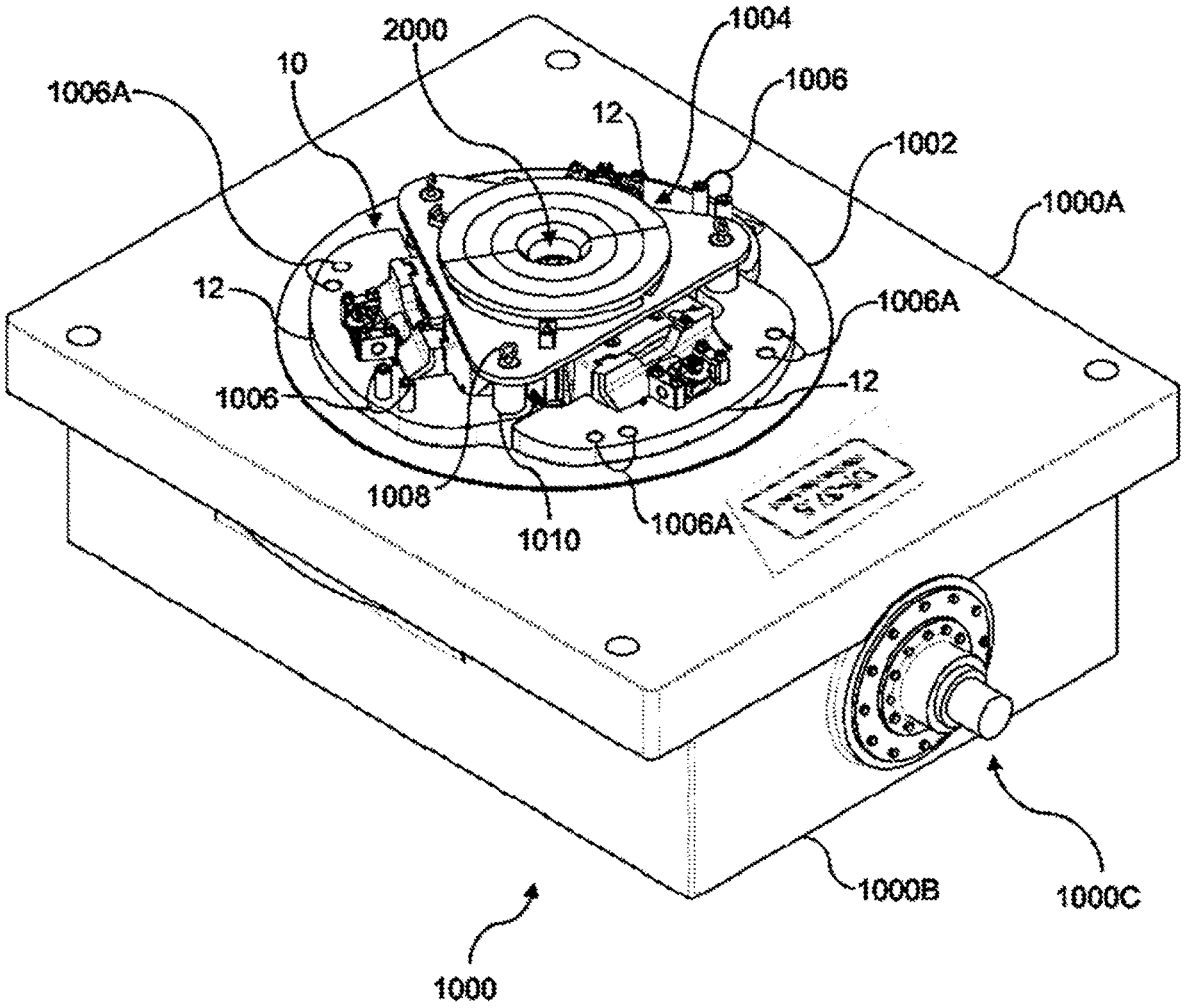
FIG. 1 is an isometric view of a portion of a rotary table and a slips apparatus, according to embodiments of the present disclosure.

Embodiments of the present disclosure relate to a slips apparatus and methods of using same. The slips apparatus is configured to grip and hold a portion of a tubular, or a string of tubulars, within a central bore of the slips apparatus so that a tubular can be added or removed from the string of tubulars during drilling or other operations at a well.

The embodiments of the present disclosure relate to a slips apparatus that is configured to move between a first position and a second position. The first position may also be referred to herein as an upper position, a raised position, a disengaged position or a non-gripping position. The gripping components can have an inner surface that defines a plane that is not parallel to a central axis of the slips apparatus, which may also be referred to as being positioned at a predetermined oblique angle, also referred to a non-parallel angle, relative to the central axis, when the slips apparatus is in the first position. In some embodiments of the present disclosure, the plane of a gripping component in the first position can be at a predetermined oblique angle relative to the central axis. In some embodiments of the present disclosure, when the slips apparatus is in the first position an upper portion of gripping components of the slips apparatus are positioned at a greater distance from a central axis of the slips apparatus than a lower portion of the same gripping components. In some embodiments of the present disclosure, the upper portion of the gripping components are positioned above an upper portion of non-gripping components. When the slips apparatus is in the first position, a portion of a tubular may extend through the slips apparatus and rotate, even off center, with less incidents of striking the slips apparatus, as compared to known slips apparatus.

The second position may also be referred to herein as a lower position, a lowered position, an engaged position or a gripping position. When in the second position, the plane defined by the gripping components may be substantially parallel to the central axis and the gripping components are positioned to engage an outer surface of a portion of a tubular that extends through the slips apparatus. In some embodiments of the present disclosure, the upper portion of the gripping components of the slips apparatus in the second position are positioned at substantially the same, or the same, distance from the central axis than the lower portion of the same gripping components. In some embodiments of the present disclosure, the upper portion of the gripping components may be substantially at or below the upper portion of the non-gripping components when the slips apparatus is in the second position.

In some embodiments of the present disclosure, the slips apparatus further includes an actuation assembly that can assist the slips apparatus to move between the first position and the second position.

Definitions

Unless defined otherwise, all technical and scientific terms used herein have the same meaning as commonly understood by one of ordinary skill in the art to which this disclosure belongs.

As used herein, the term " . . . " describes

As used herein, the term "about" refers to an approximately +/−10% variation from a given value. It is to be understood that such a variation is always included in any given value provided herein, whether or not it is specifically referred to.

Embodiments of the present disclosure will now be described by reference to FIG. 1 to FIG. 13B, which show representations of the slips apparatus and methods of using same, according to the present disclosure.

FIG. 1 shows a slips apparatus 10 for use with a rotary table 1000. The rotary table 100 can be installed in a drilling floor of a rig that is used to drill an oil and/or gas well therebelow. As will be appreciated by those skilled in the art, the slips apparatus 10 can be used in various different applications including, but not limited to: drilling of wells other than oil and/or gas wells; workover operations of various types of wells; completion of various types of wells; and, other operations where it is desirable to suspend a single tubular or a string of tubulars that are extending through the rotary table 1000 or otherwise through the floor of a rig.

The rotary table 1000 includes an upper portion 1000A, a lower portion 1000B and a rotary drive assembly 1000C. The rotary table 1000 also includes a master bushing 1002 that is coupled to an inner surface of the rotary table 1000. The slips apparatus 10 is operatively coupled to the master bushing 1002 for defining a central bore 2000 that extends between an upper portion 10A and a lower portion 10B (shown in FIG. 2) of the slips apparatus 10. In some embodiments of the present disclosure, the slips apparatus 10 may define one or more drive lug apertures 1006A that are configured to receive a drive lug 1006 therethrough. The drive lug 1006 operatively couples the slips apparatus 10 to the master bushing 1002, as would be understood by those skilled in the art.

A centralizer assembly 1004 may be positioned upon the slips apparatus 10 and connected thereto by a connector pin 1010 that extends into one or more components of the slips apparatus 10, for example one or more slip block assemblies 12. The connector pin 1010 may be removable by the action of a removable connector pin tab 1008, as will be understood by those skilled in the art. The centralized assembly 1004 includes one or more centralizer plates 1005 for defining an upper portion of the central bore 2000 (see centralizer plates 1005A, 1005B and 1005C shown in FIG. 3). The number of centralizer plates 1005 used in the centralizer assembly 1004 can change depending upon the outer diameter of the tubular(s) that will extend through the central bore 2000.

Figure 2A:
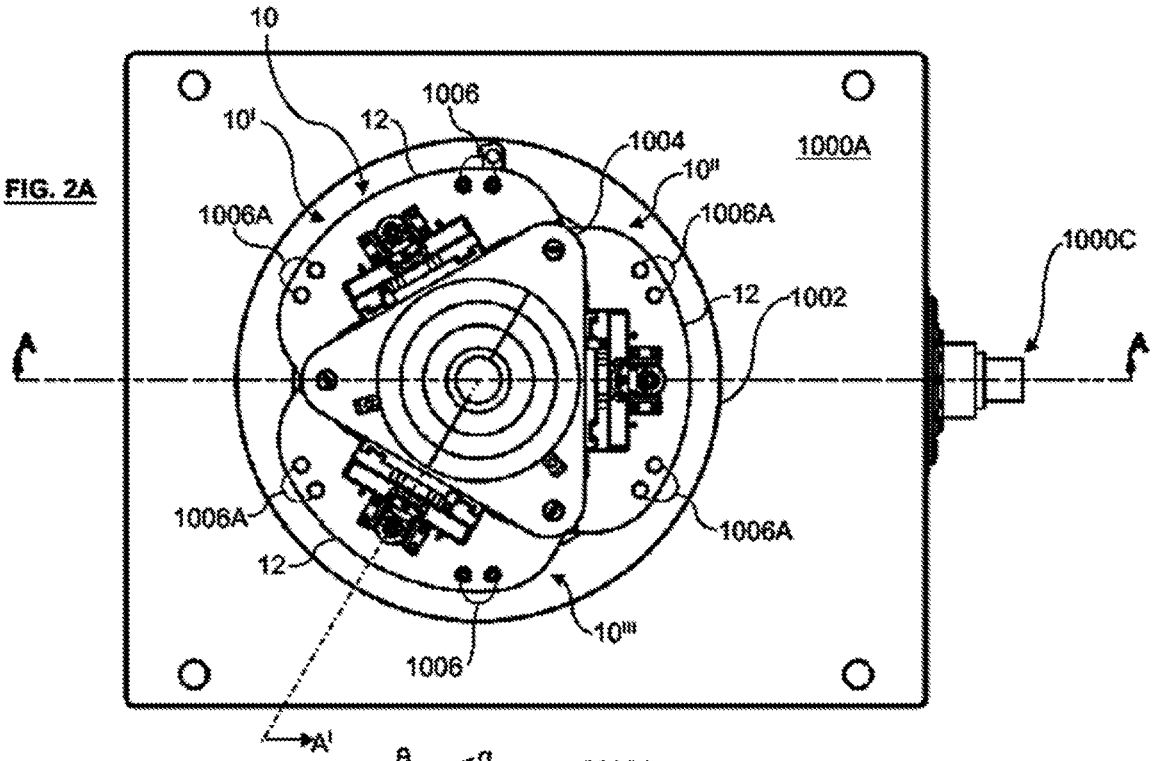
FIG. 2A shows a top-plan view of the rotary table and the slips apparatus of FIG. 1.

FIG. 2A shows a non-limiting implementation of the slips apparatus 10 as comprising three sections $\mathbf{10}^{1}$, $\mathbf{10}^{11}$ and $\mathbf{10}^{111}$ each of which are operatively coupled with the master bushing 1002. The three sections $\mathbf{10}^{1}$, $\mathbf{10}^{11}$ and $\mathbf{10}^{111}$ are arranged generally opposite to each other so that in operation, as discussed further below, the sections 10$^{1}$, 10$^{11}$ and 10$^{111}$ act together to impart or release a clamping force upon an outer surface of a tubular that is extending through the central bore 2000. In some embodiments of the present disclosure, there is a connector pin 1010 used to couple section 10$^{1}$ to section 10$^{11}$ and a further connector pin 1010 to couple section 10$^{11}$ to section 10$^{111}$ and a further connector pin 1010 to couple section 10$^{111}$ to section 10$^{1}$. While FIG. 2A shows three sections 10$^{1}$, 10$^{11}$ and 10$^{111}$, the person skilled in the art will appreciate that the slips apparatus 10 may include more or less of such sections.

Figure 2B:
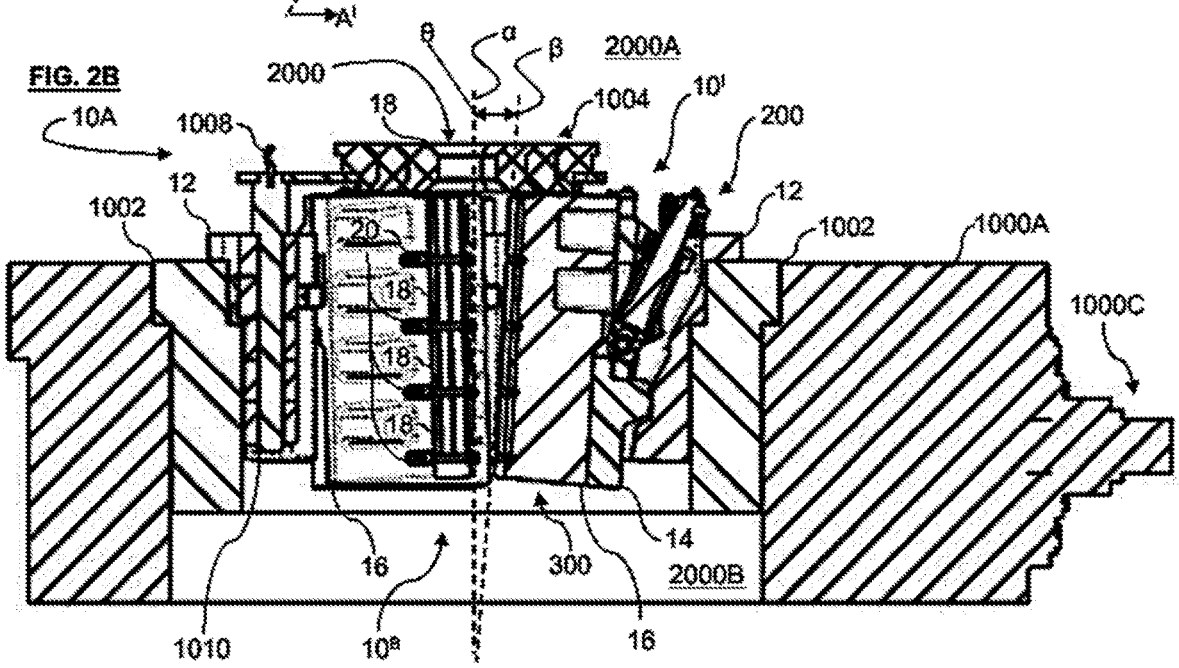
FIG. 2B shows a cross-sectional view of the rotary table and the slips apparatus of FIG. 1 taken through line A-A in FIG. 2A.

As shown in FIG. 2B, the slips apparatus 10 includes the upper portion 10A and the lower portion 10B, with the central bore 2000 extending therebetween from an above-the well area 2000A to an upper portion of the well 2000B. Each section 10$^{1}$, 10$^{11}$ and 10$^{111}$ of the slips apparatus 10 also comprises one or more gripping components 300. In the non-limiting implementation shown in FIG. 2B, the gripping components 300 include a die set 17 that defines a face that is configured to engage a tubular (not shown) that extends through the central bore 2000. The angular position of the face of the die set 17 is identified in FIG. 2B by a line β. FIG. 2B shows a central axis α of the central bore 2000, where the central axis α represents the axis along which a tubular can enter and leave the central bore 2000. FIG. 2B also shows an angle θ that is defined between the central axis α and the line β. As will be discussed further below, when the gripping components 300 of the slips apparatus 10 move between a first position and a second position, the angle θ changes.

FIG. 2B shows a non-limiting implementation of the section 10$^{1}$ of the slips apparatus 10 as comprising a slip block assembly 12, a die actuator block 14, a die carrier 16 and the die set 17. The die set 17 comprises one or more dies 18 that are coupled to an inner surface of the die carrier 16 by die retainers 20. As used herein, the term "gripping component 300" is used to refer at least to the die set 17 of each section of the slips apparatus 10. Gripping components 300 may also be used herein refer to any other components of the slips apparatus 10 that move between a first position and a second position in order to grip and to release a tubular within the central bore 2000 including, but not limited to: one or more of the die actuator block 14 and the die carrier 16. As will be appreciated by those skilled in the art, section 10$^{11}$ and section 10$^{111}$ (or however many sections a particular embodiment of the slips apparatus 10 includes) may have substantially the same, or the same, components as the section 10$^{1}$. As used herein, the term "non-gripping component 301" refers to at least the slip block assembly 12 and any other component of the slips apparatus 10 that does not move between the first position and the second position in order to grip and to grip (or release) a tubular within the central bore 2000. As used herein, the term "associated" refers to one or more components that form part of the same section 10$^{1}$, 10$^{11}$, 10$^{111}$. For example, section 101 can comprise a non-gripping component 301 and one or more associated gripping components 300 and, as further described below, an associated actuator assembly 200.

Figure 3:
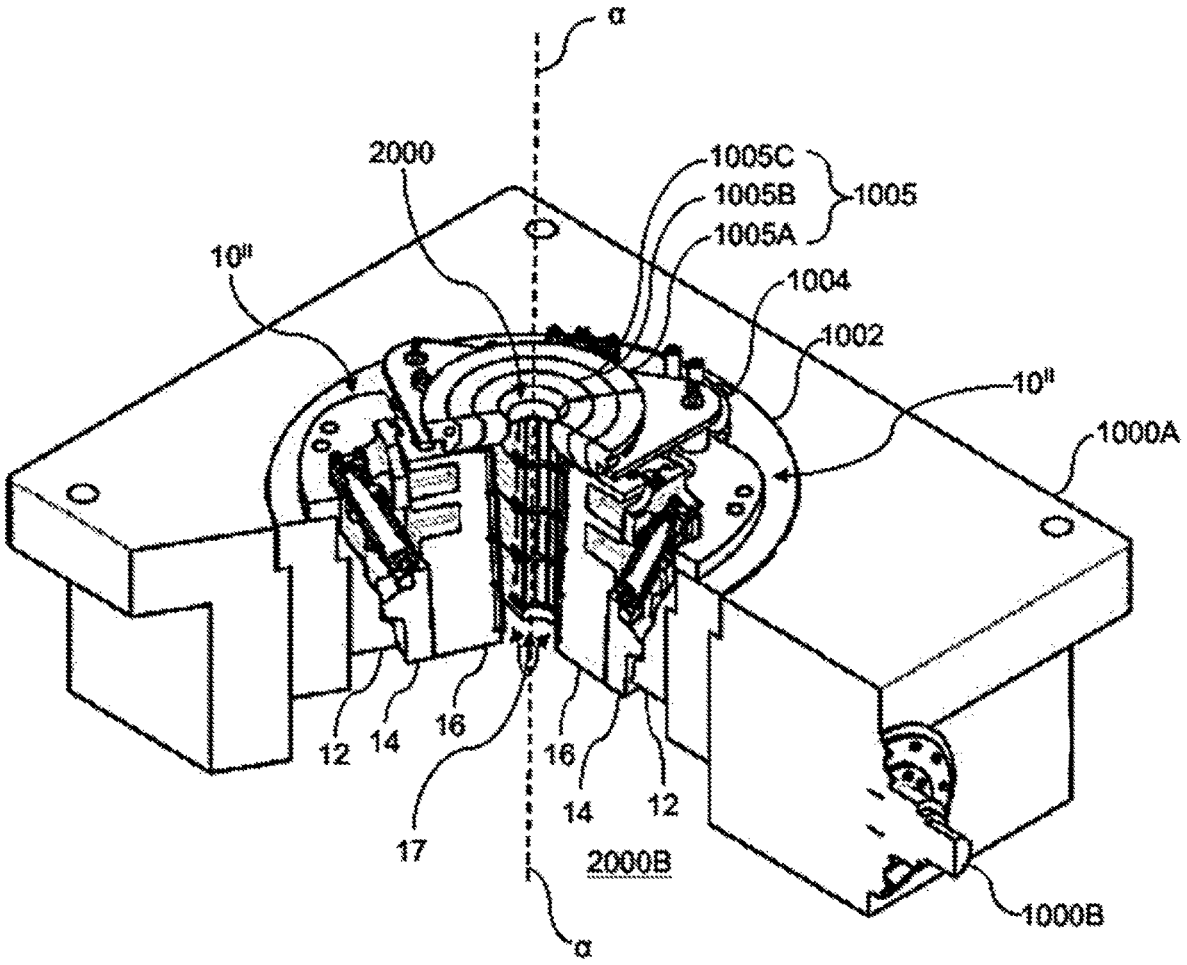
FIG. 3 is a partial cross-sectional view of the rotary table and the slips apparatus taken through lines $A^1$-$A^1$ in FIG. 2A.

FIG. 3 shows a partial cut-away of a non-limiting implementation of the slips apparatus 10 with three sections 10$^{1}$, 10$^{11}$, 10$^{111}$, each with a die assembly 17 positioned within the central bore 2000 and positioned above the upper portion of the well 2000B.

Figure 4A:
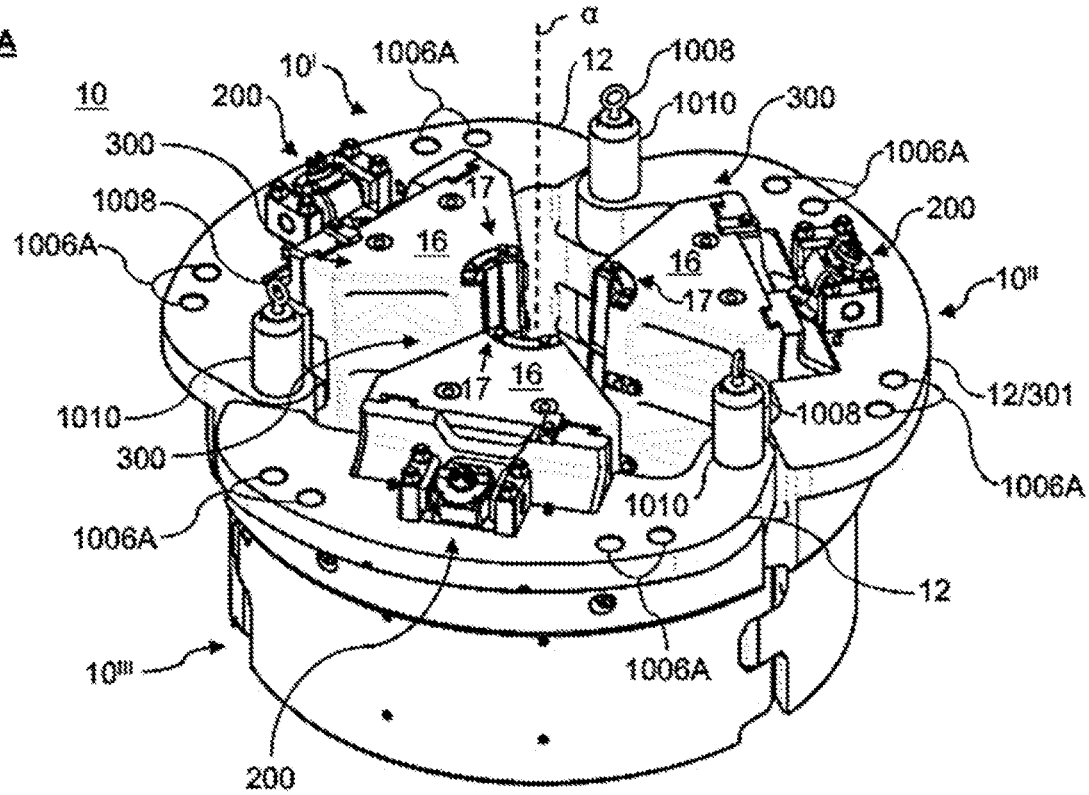
FIG. 4A is an isometric view of the slips apparatus of FIG. 1 in a first position.
Figure 4B:
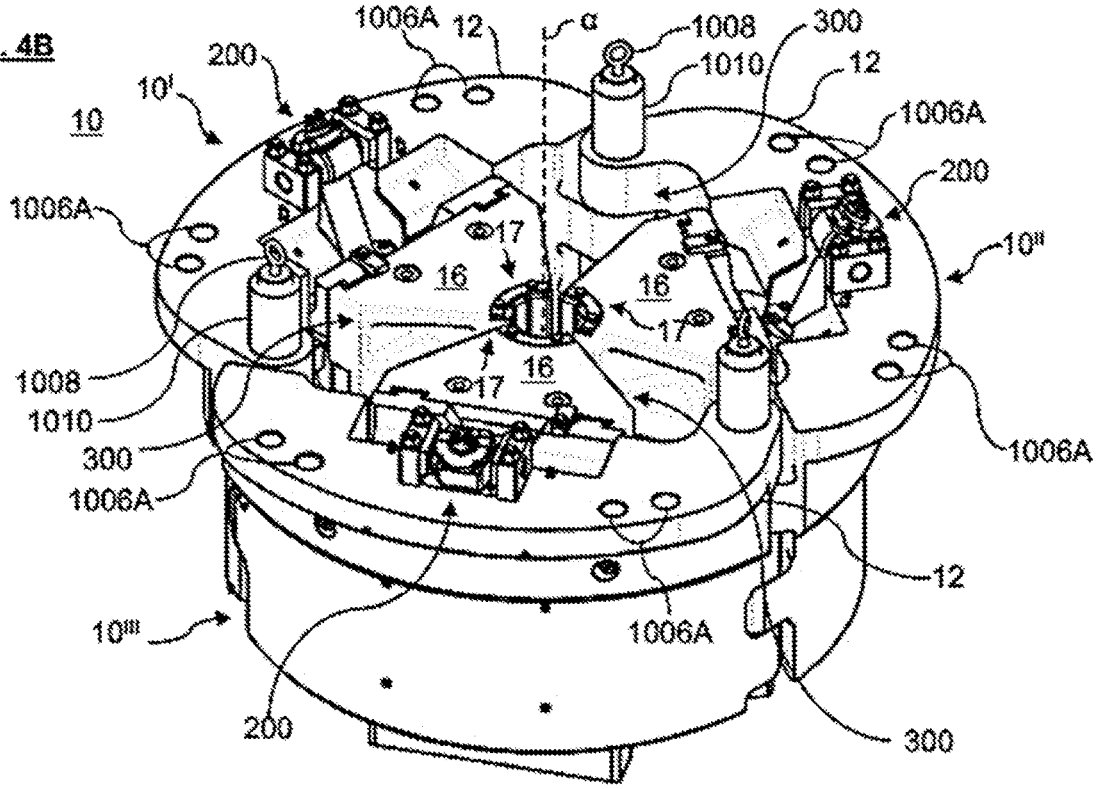
FIG. 4B is an isometric view of the slips apparatus of FIG. 1 in a second position.

FIGS. 4A and 4B show a non-limiting implementation of the slips apparatus 10 in the first position (FIG. 4A) and in the second position (FIG. 4B). Each section 10$^{1}$, 10$^{11}$ and 10$^{111}$ comprises an actuator assembly 200 that are each configured to move one or more associated gripping components 300 between the first position and the second position. For clarity, the actuator assembly 300 is not considered part of either of the non-gripping components 301 or the gripping components 300.

FIGS. 5A-C and 7A-C show non-limiting implementations of the slips apparatus 10 in the first position. The actuator assembly 200 is shown as comprising an upper pivot assembly that includes a pivot member 210 and an actuator 202. The pivot member 210 is operatively coupled to a bracket 212 on each side. Each bracket 212 is fixed to an upper surface of the slip assembly block 12. The actuator 202 has a first end 202A and a second end 202B and the actuator 202 can extend or retract, thereby increasing or decreasing the distance between the ends 202A, 202B. As will be appreciated by those skilled in the art, the actuator 202 can be hydraulically power, pneumatically powered or electrically powered. For example, the actuator 202 can be hydraulic cylinder that is part of a hydraulic circuit that further includes a source of hydraulic fluid, one or more valves, optionally a pump, and a controller (both not shown). The controller can send an extend command to the valves and optional pump to cause hydraulic fluid to flow from the source into a portion of the actuator 202 to cause the actuator 202 to extend. Similarly, the controller can send a retract command to the valves and optional pump to cause hydraulic fluid to flow from the actuator 202 back to the source to cause the actuator 202 to retract. In other embodiments of the present disclosure, the actuator 202 can extend and retract due to the flow of a gas into and out of the actuator 202. In other embodiments of the present disclosure, the actuator 202 can extend and retract due to the action of one or more electric motors and/or one or more solenoids.

In some embodiments of the present disclosure, the pivot member 210 is configured like a ball joint with a socket 211A and a ball member 211B that is internally positioned within the socket 211A. The ball member 211B and, therefore, the first end 202A of the actuator 202 can move in two or more degrees of freedom. For example, the first end 202A of the actuator 202 can yaw (swivel) about a longitudinal axis of the actuator 202 that extends between the first 202A and the second end 202B, and the first end 202A of the actuator 202 can tilt (pitch) and pivot (roll).

When the actuator 202 is retracted the slips apparatus 10 is in the first position. As shown in FIG. 5A, when viewed from above the die sets 17 of each section 10$^{1}$, 10$^{11}$, 10$^{111}$ are separated from each other and they do not form a substantially contiguous surface for gripping a tubular within the central bore 2000. The separation between the die sets 17 of section 10$^{1}$ and section 10$^{111}$ is further shown in FIG. 5B. Furthermore, when the slips apparatus 10 is in the first position, the face of each die set 17 is positioned at an angle θ as shown by line β relative to the central axis α (see FIG. 5C). When the slips apparatus 10 is in the first position, the line β is not parallel to the central axis α. When the slips apparatus 10 is in the first position the angle θ is greater than about 1 degrees, greater than about 5 degrees, greater than about 10 degrees.

In some embodiments of the present disclosure, when the slips apparatus 10 is in the first position, an upper surface of the gripping components 300 is positioned apart from the central axis α at a distance that is greater than a distance that a lower surface of the gripping components 300 is positioned from the central axis α. For example, the gripping components 300 can include a die carrier 16 with an upper surface 16A that is positioned a first distance X from the central axis α and a lower surface 16B that is positioned a second distance Y from the central axis α (see FIGS. 5A and 7A). When the slips apparatus 10 is in the first position, the first distance X is greater than the second distance Y.

In some embodiments of the present disclosure, when the slips apparatus 10 is in the first position, an upper portion of the gripping components 300 is positioned a distance H above an upper surface of the non-gripping components, shown as the distance between line Z and upper surface 12A in FIG. 5C.

FIGS. 6A-C and 8A-C show non-limiting embodiments of the slips apparatus 10 in the second position. As shown in FIG. 6A, when viewed from above the die sets 17 of each section $\mathbf{10}^{1}$, $\mathbf{10}^{11}$, $\mathbf{10}^{111}$ are positioned substantially abutting each other and they form a substantially contiguous surface for gripping a tubular within the central bore 2000. The abutting relationship between the die sets 17 of section $\mathbf{10}^{1}$ and section $\mathbf{10}^{111}$ is further shown in FIG. 6B. Furthermore, when the slips apparatus 10 is in the second position, the face of each die set 17 is positioned substantially parallel or parallel to the central axis $\alpha$ (see FIG. 6C).

When the slips apparatus 10 is in the second position, a distance $X^1$ that the upper surface 16A of the die carrier 16 is positioned from the central axis $\alpha$ is substantially equal to or equal to the distance Y that the lower surface 16B is positioned from the central axis $\alpha$ (see FIG. 8C).

In some embodiments of the present disclosure, when the slips apparatus 10 is in the second position, the upper portion of the gripping components 300 is positioned a distance $H^1$ below an upper surface of the non-gripping components, shown between line Z and the upper surface 12A (for example, see FIGS. 6C and 8C).

Figure 9:
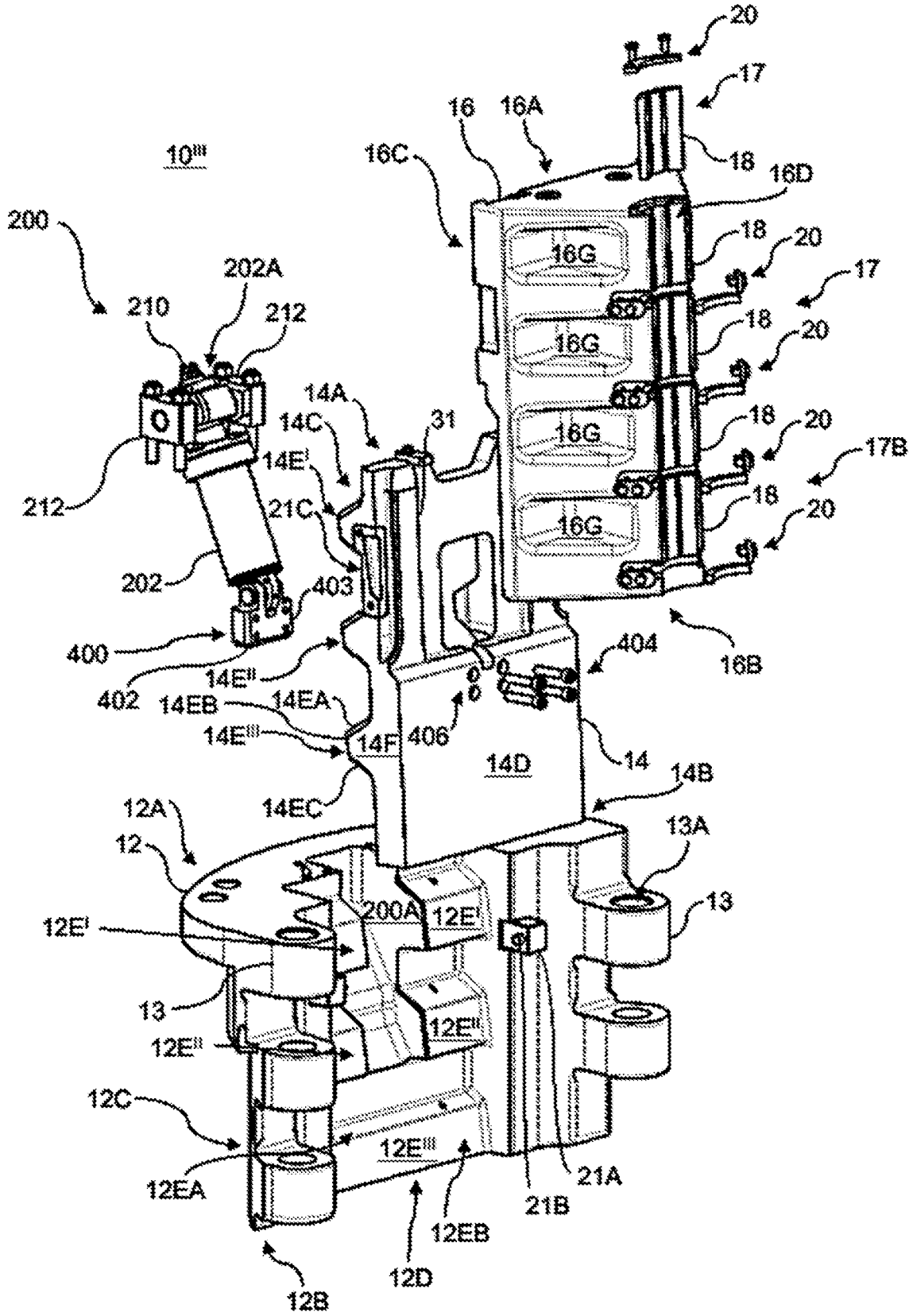
FIG. 9 is an isometric, partially exploded view of the section of FIGS. 7A-C.
Figure 10A:
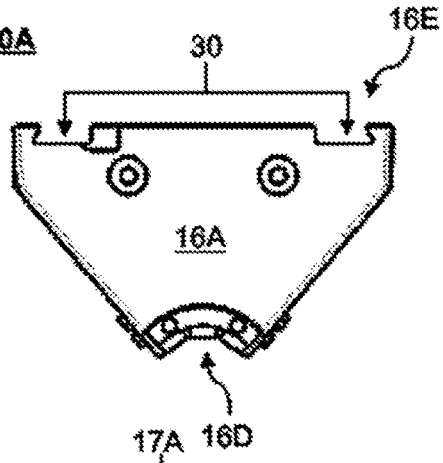
FIG. 10A is a top-plan view of a die carrier and a die set, according to embodiments of the present disclosure.
Figure 10B:
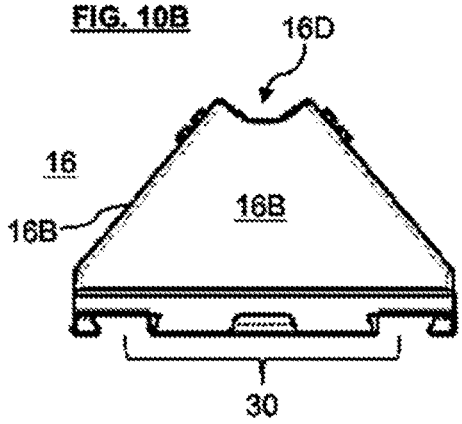
FIG. 10B is a bottom-plan view of the die carrier and die set of FIG. 10A.
Figure 10C:
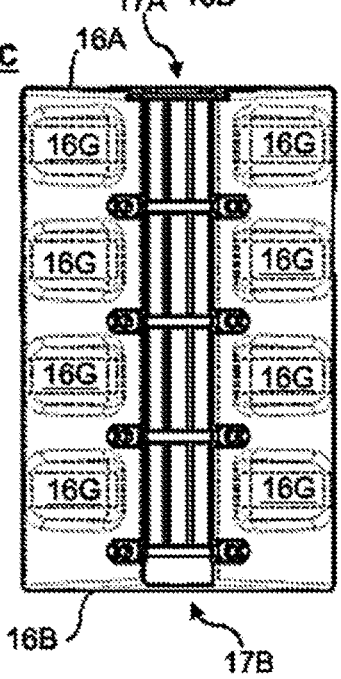
FIG. 10C is a front-elevation view of the die carrier and die set of FIG. 10A.
Figure 10D:
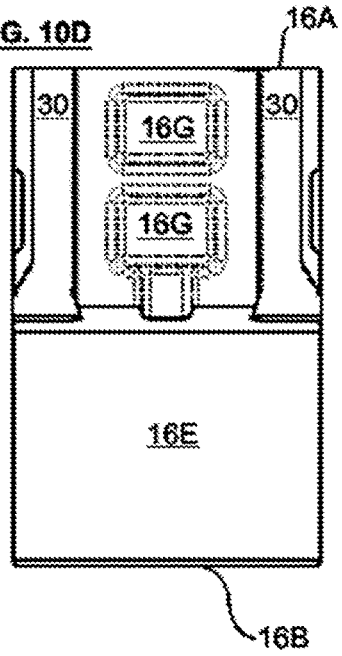
FIG. 10D is a back-elevation view of the die carrier and die set of FIG. 10A.
Figure 10E:
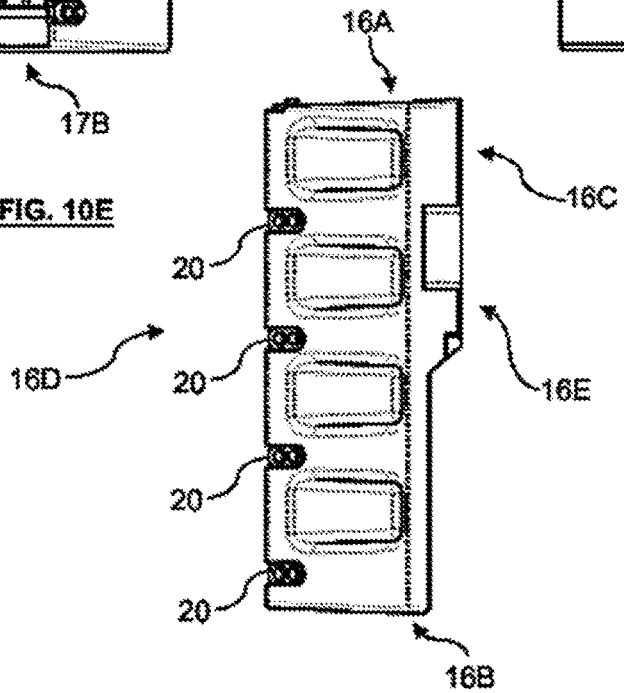
FIG. 10E is a side-elevation view of the die carrier and die set of FIG. 10A.

FIG. 9 shows a non-limiting embodiment of the section $\mathbf{10}^{111}$ as comprising the slip block assembly 12, the actuator assembly 200, the die actuator block 14, the die carrier, 16 and the die set. The slip block assembly 12 defines the upper surface 12A and the lower surface 12B. The slip block assembly 12 is also shown as defining multiple, vertically-spaced receiving members 13 on each side of the slip block assembly 12. Each of receiving members 13 is configured to mate with the lateral receiving member 13 of the adjacent section $\mathbf{10}^{1}$ and $\mathbf{10}^{11}$, respectively. When mated, apertures 13A defined by each receiving member 13 can align so that the connector pin 1010 can be inserted and retained thereby so as to operatively couple together the sections $\mathbf{10}^{1}$, $\mathbf{10}^{11}$, $\mathbf{10}^{111}$ of the slips apparatus 10.

The slip block assembly 12 can further define an external surface 12C and an internal surface 12D. The external surface 12C can be configured to match the profile of the rotary table 1000 to facilitate receipt of the slips apparatus 10 within the rotary table 1000. The internal surface 12D can define further features of the slips apparatus 10. For example, the internal surface 12D can define a channel 200A that is configured to receive one or more portions of the actuator assembly 200 therein. The internal surface 12D can further define one or more cam surfaces 12E. As shown in the non-limiting embodiment of FIG. 9, the internal surface 12D can define three protruding surfaces. Closest to the upper surface 12A is a first protruding surface $\mathbf{12}E^{1}$, closer to the lower surface 12B is a second protruding surface $\mathbf{12}E^{11}$ and closest to the lower surface 12B is a third protruding surface $\mathbf{12}E^{111}$. In some embodiments of the present disclosure, the first protruding surface $\mathbf{12}E^{1}$ and, optionally, the second protruding surface $\mathbf{12}E^{11}$ are split to define the channel 200A. Each of the protruding surfaces has an upper ramp portion 12EA (for example as shown on the third protruding surface $\mathbf{12}E^{111}$ but understood to be part of the first and second protruding surfaces $\mathbf{12}E^{1}$ and $\mathbf{12}E^{11}$) and an abutting portion 12EB (understood to be part of all protruding surfaces).

The actuator assembly 200 further comprises a bracket assembly 400 that comprises a bracket 402 and one or more bracket connectors 404. The bracket assembly 400 is configured to operatively couple the second end 202B of the actuator to the gripping components 300. FIG. 9 shows the non-limiting embodiment where the gripping components 300 comprise the die actuator block 14, the die carrier 16 and the die set 17. The bracket 402 defines one or more apertures 403 that are alignable with one or more associated apertures 406 that are defined by the die actuator block 14. When aligned, the bracket connectors 404 can be received through both sets of apertures 403, 406 and removably retained therein in order to couple the actuator assembly 200 to the gripping components 300. So that when the actuator 202 extends or retracts, the gripping components 300 will move in a corresponding fashion. The skilled in the art will appreciate that other mechanisms or components can be used to operatively couple the actuator assemble 200 to the gripping components 300.

FIG. 9 shows the die actuator block 14 as defining an upper surface 14A, a lower surface 14B, an external surface 14C and an internal surface 14D. The external surface 14C can define one or more extending surfaces. For example, closest to the upper surface 14A is a first protruding surface $\mathbf{14}E^{1}$, closer to the lower surface 14B is a second protruding surface $\mathbf{14}E^{11}$ and closest to the lower surface 14B is a third protruding surface $\mathbf{14}E^{111}$. Each of the protruding surfaces has an upper ramp portion 14EA (for example as shown on the third protruding surface $\mathbf{14}E^{111}$ but understood to be part of the first and second protruding surfaces $\mathbf{14}E^{1}$ and $\mathbf{14}E^{11}$), an abutting portion 14EB (understood to be part of all protruding surfaces) and a lower ramp portion 14EC.

The internal surface 14D defines the one or more apertures 406 so that the bracket connectors 404 can extend therethrough and into the apertures 403 of the bracket assembly 400. The internal surface 14D may be configured to be substantially flat, or to define one or more portions that are substantially flat.

Together the slip block assembly 12 and the die actuator block 14 can form a cam assembly 21 that is configured to slidingly guide the movement of the gripping components 300 between the first and second position when moved by the extending and retracting of the actuator assembly 200. For example, the slip block assembly 12 may further comprise a first cam member 21A and a protruding member 21B (shown in FIG. 9 between the internal surface 12D and the vertically spaced members 13) and the die actuator block 14 may further comprise a second cam member 21C (shown in FIG. 9 on a lateral surface 14F positioned between the first protruding surface $\mathbf{14}E^{1}$ and the second protruding surface $\mathbf{14}E^{11}$). The second cam member 21C can be configured as a channel that receives and retains the protruding member 21B. The second cam member 21C can define a path of travel that the protruding member 21B travels when the actuator assembly 200 moves the gripping components 300.

As will be appreciated by the person skilled in the art, the first cam member 21A can be positioned on either of the slip block assembly 12 and the second cam member 21C can be positioned on the die actuator block 14 or vice versa. The positioning of each cam member 21A, 21C can be modified from those depicted in the figures and described herein provided that the cam assembly 21 slidingly guides the slips apparatus 10 to move between the first position and the second position.

FIGS. 9 and 10A-E both show the die carrier 16 as defining an upper surface 16A, a lower surface 16B, an external surface 16C and an internal surface 16D. The external surface 16C is configured to releasably mate with the one or more portions of the internal surface 14D of the die actuator block 14. For example, the external surface 16D may define one or more connection features 30, such as dovetail grooves that are configured to releasably mate with corresponding pins 31 that extend from the internal surface of the die actuator block 14. As will be appreciated by the skilled reader, the connection features 30 may be reversed from described above so that the dovetail grooves are defined on the internal surface 14D and the pins 31 extend from the external surface 16C or other connection features 30 can be used to releasably mate the die actuator block 14 and the die carrier 16. As show most clearly in FIG. 10B, the internal surface 16D can be curvilinear and configured to releasably retain the die set 17.

FIGS. 9 and 10A-E both show the die set 17 has having an upper portion 17A and a lower portion 17B between the two portions can be one or more dies 18 that are releasably retained against the internal surface 16D by one or more die retainers 20. The dies 18 can define multiple teeth that are configured to grip the outer surface of a portion of a tubular positioned within the central bore 2000. The dies 18 can be arranged in various patterns. As shown in FIGS. 10A-E, different implementations of the die carrier 16 can be of various sizes in order to accommodate tubulars of different outer diameters. For example, a die carrier 16H may releasably retain a die set 17H with four rows of two dies 18, die carrier 16I may releasably retain a die set 17I with four rows of three dies 18, die carrier 16J may releasably retain a die set 17J with four rows of four dies 18, die carrier 16K may releasably retain a die set 17K with four rows of six dies 18 and die carrier 16L may releasably retain a die set 17L with four rows of eight dies 18. As will be appreciated by those skilled in the art, the implementations shown in FIGS. 10A-E are not intended to be limiting to the number of rows or total number of dies 18.

Figure 11A:
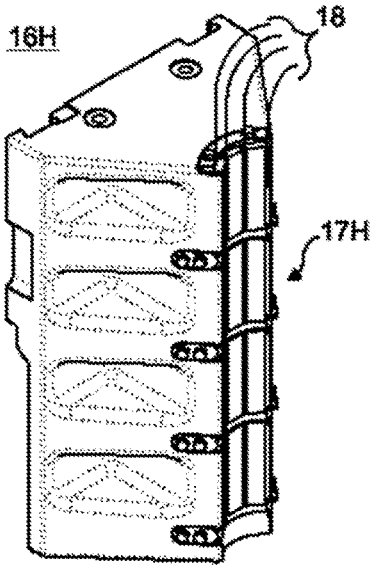
FIG. 11A is an isometric view of the die carrier and die set of FIGS. 10A-E.
Figure 11B:
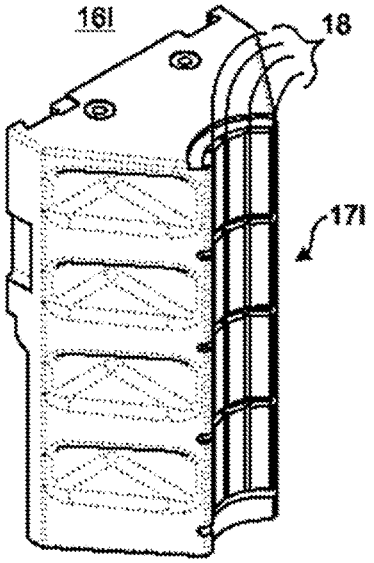
FIGS. 11B-E are isometric views showing further embodiments of die carriers and die sets, according to the present disclosure.
Figure 11C:
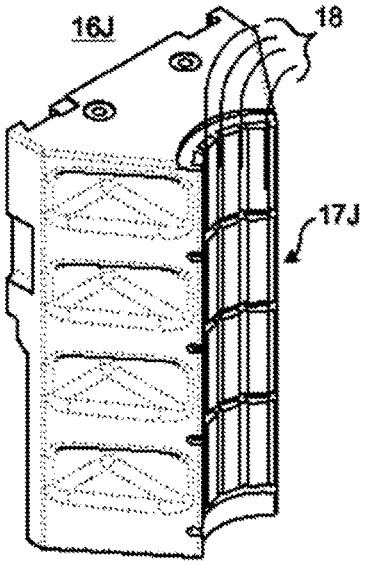
Figure 11D:
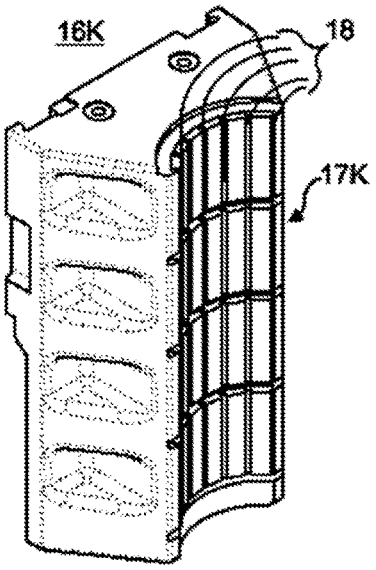
Figure 11E:
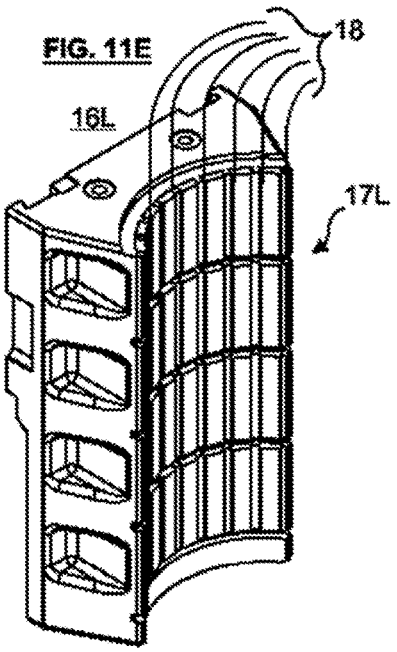

FIGS. 11A-E shows an isometric view of different embodiments of the die carrier 16 and the die set 17. FIG. 11A shows a die set 17H with three dies 18 secured to a die carrier 16H. FIG. 11B shows a die set 17I with four dies 18 secured to a die carrier 16I. FIG. 11C shows a die set 17J with four dies 18 secured to a die carrier 17J. FIG. 11D shows a die set 17K with six dies 18 secured to a die carrier 16K. FIG. 11E shows a die set 17L with eight dies 18 secured to a die carrier 16L. As will be appreciated by those skilled in the art, the number of dies 18 in a given die set 17 may vary between sections and can range between one and about twenty dies 18.

Figure 12:
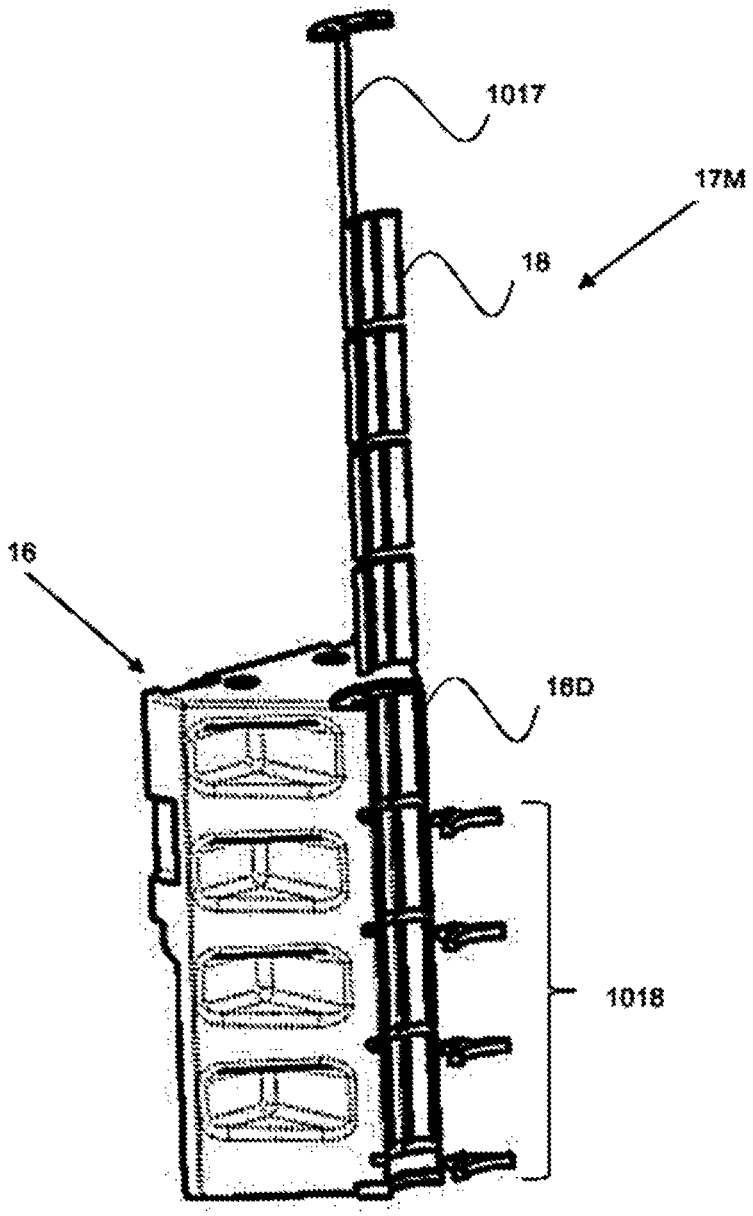
FIG. 12 shows an exploded isometric view of one embodiment of a die set according to the present disclosure.

FIG. 12 shows another embodiment of a die set 17M that comprises a die set rod 1017 with multiple dies 18 coupled thereto. The die set rod 1017 can be inserted into the internal face 16D of the die carrier 16 and releasably secured thereto by one or more die retainers 1018. While only three dies 18 are shown as being coupled to the die set rod 1017, the skilled person will appreciate that less or more dies 18 can be coupled to the die set rod 1017.

Figure 13A:
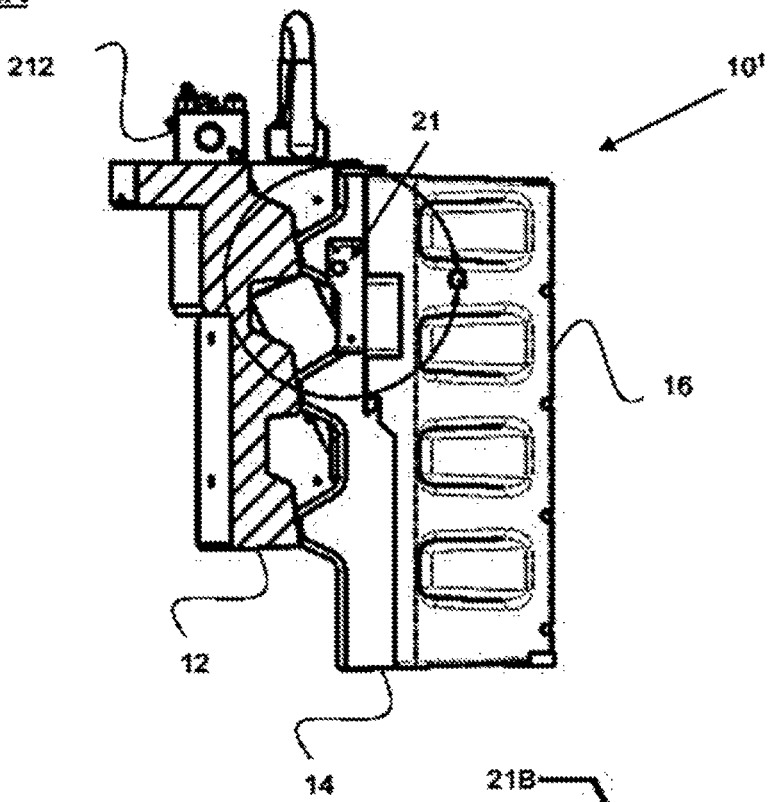
FIG. 13A is a partial cutaway, side elevation view of a section.
Figure 13B:
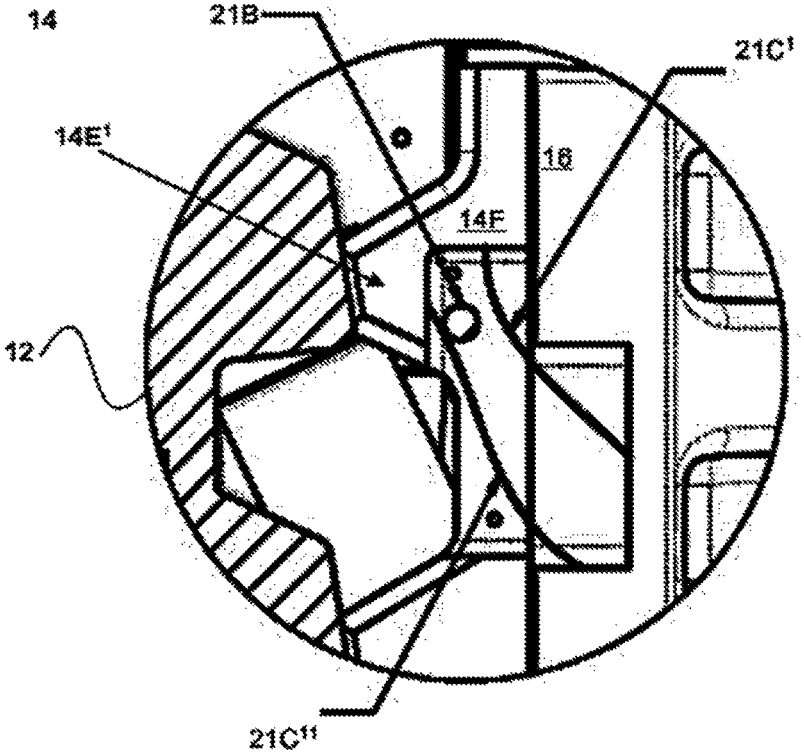
FIG. 13B is a closer view of a cam assembly identified in circle G shown in FIG. 13A.

FIG. 13A shows a side, partial cutaway view of the section $\mathbf{10}^1$ with a circle indicating a zoomed in view of the cam assembly 21. FIG. 13B shows the zoomed in view with the protruding member 21B positioned at one end of the second cam member 21C, shown as a path defined by edges $\mathbf{21}C^1$ and $\mathbf{21}C^{11}$. When the protruding member 21B is at one end of the second cam member 21C, the section $\mathbf{10}^1$ is in the second position and when the protruding member 21B is at the opposite end of the second cam member 21C, the section $\mathbf{10}^1$ is in the first position.

Various components of the slips apparatus 10 can be constructed to reduce the overall mass of a given component while maintaining that component's structural integrity and strength. For example, the die carrier 16 may define one or more voids 16G that reduce the overall mass of the die carrier 16 while maintaining structural integrity and strength.

In some embodiments of the present disclosure, the slips apparatus 10 forms part of a system that also includes a power source, conduits that connect the power source to the actuator assembly 200 and a controller circuit. As described above, the actuator assembly 200 can be powered by the flow of hydraulic fluid, gas or it may be electronically actuated. As such, the power source can a source of hydraulic power, pneumatic power or electric power. Accordingly, the conduits can be selected based on suitability for conducting power from the power source and for controlling the flow of power therethrough. The control circuit can be used to send commands to portions, including valves of the conduits in order to control when the actuator assembly 200 receives power and whether the actuator 202 extends or retracts and to which degree. The control circuit may also include a user interface to allow a user to operate the system.

In operation, the slips apparatus 10 moves between the first position and the second position based upon moving the actuator 202 in a first direction and a second direction. In some embodiments of the present disclosure, when the actuator 202 is partially, substantially fully or fully extended the slips apparatus 10 can be in the first position and when the actuator 202 is substantially fully retracted or fully retracted the slips apparatus 10 is in the second position. In other embodiments of the present disclosure, extending the actuator 202 moves the slips apparatus 10 towards and into the second position and retracting the actuator 202 moves the slips apparatus 10 towards and into the first position.

In the first position, the gripping components 300 are positioned so that the inner surface thereof is at an oblique angle to the central axis $\alpha$. The upper portion of the gripping components 300 can be positioned further away from the central axis $\alpha$ than the lower portion of the gripping components 300. In some embodiments of the present disclosure, the upper portion of the gripping components may also be positioned above the upper portion of the non-gripping components 302. When in the first position, the gripping components 300 do not form a contiguous gripping surface.

When the slips apparatus 10 is in the first position, a tubular can be received within the central bore 2000 substantially along the central axis $\alpha$. The tubular can approach the slips apparatus 10 from above the bore 2000A or from the well bore 2000B. The tubular may be an individual tubular or it may be connected to other tubulars to form a string of tubulars. Because the gripping components 300 are positioned at a predetermined oblique angle to the central axis $\alpha$ and distanced therefrom should the received tubular rotate off-centre from the central axis $\alpha$ there will be a decreased incidence of strikes between the tubular and the components of the slips apparatus 10.

Actuating the actuator 202 in a first direction will cause the gripping components 300 to move from the first position towards the second position. In some embodiments of the present disclosure as the gripping components 300 move towards the second position, the external surface of a gripping component 300 will slide along the internal surface of the associated non-gripping components 302 and the profile of the two surfaces can facilitate moving the slips apparatus 10 into the second position. For example, while in the first position, the lower ramp portion 14EC of each protruding surface 14$E^1$, 14$E^{11}$, 14$E^{111}$ will be positioned above or upon the upper ramp portion 12EA of each associated protruding surface 12$E^1$, 12$E^{11}$, 12$E^{111}$. As the slips apparatus 10 moves towards the second position, the lower ramp portions 14EC will slide along their respective associated upper ramp portions 12EA until the abutting portions 14EB abut against the abutting portions 12EB. The slope (relative to the central axis α) of each abutting portion 12EB can be substantially the same so that when the abutting portions 12EB, 14EB abut against each other, the upper portion 17A of the die set 17 is substantially at the same angle relative to the central axis α as the lower portion 17B and the die set 17 will be substantially parallel to the central axis α.

Actuating the actuator 202 in a second direction, that is opposite to the first direction, will cause the gripping components 300 to move from the second position towards the first position. As the gripping components 300 move towards the first position, the external surface of a gripping component 300 will slide along the internal surface of the associated non-gripping components 302 and the profile of the two surfaces can facilitate moving the slips apparatus 10 into the first position. For example, while in the second position, the abutting portions 14EB abut against the abutting portions 12EB. As the actuator 202 moves in the second direction, the abutting portions 12EB, 14EB will disengage and the lower ramp portion 14EC of each protruding surface 14$E^1$, 14$E^{11}$, 14$E^{111}$ will slide upon the upper ramp portion 12EA of each associated protruding surface 12$E^1$, 12$E^{11}$, 12$E^{111}$. As the slips apparatus 10 moves towards the first position, the lower ramp portions 14EC will slide along their respective associated upper ramp portions 12EA until the abutting portions 14EB are positioned above each their associated upper ramp portions 12EA.

In embodiments of the slips apparatus 10 that includes the cam assembly 21, the cam assembly 21 can slidingly guide the slips apparatus 10 to move between the first position and the second position and vice versa. For example, when the slips apparatus 10 is in the first position, the protruding member 21B will be at one end of the second cam member 21C, which is configured so that the gripping components 300 are: positioned at an oblique angle to the central axis α, positioned with the upper portion of the gripping components 300 the distance X from the central axis α that is greater than the distance Y that the lower portion is from the central axis α, positioned at a height H above the upper portion of the non-gripping components 301, or combinations thereof. In contrast, when the slips apparatus is in the second position, the protruding member 21B will be at an opposite end of the second cam member 21C which is configured so that the gripping components 300 are: positioned substantially parallel to the central axis α, positioned with the upper portion of the gripping components 300 the distance $X^1$ from the central axis α that is substantially the same as the distance Y that the lower portion is from the central axis α, positioned at a height $H^1$ at or below the upper portion of the non-gripping components 301, or combinations thereof.

When the slips apparatus 10 is in the second position, the dies 18 of the die set 17 can grip a portion of the outer surface of the received tubular. In the event that the weight of the received tubular, or the associated string of tubulars that are connected to the received tubular, is insufficient to cause the dies 18 to fully grip the tubular, movement of the actuator 202 in the second direction can increase the grip force applied through the gripping components 300 upon the outer surface of the tubular.

When the dies 18 fully grip the outer surface of the tubular, the gripping components 300 can bear against the non-gripping components 302 in order to support the received tubular, and any string of tubulars connected thereto. When the received tubular is supported, one or more further operations can be performed on the received tubular such as making or breaking a threaded connection to add or remove a tubular from above the received tubular.

We claim:

1. A slips apparatus that is connectible with a rotary table and for gripping a tubular extending through an aperture of the rotary table, the slips apparatus comprising:

(a) at least three opposed non-gripping components, each defining an inner non-gripping surface that defines one or more protruding surfaces with each protruding surface defining an upper ramp section and a first abutting portion that is substantially flat;

(b) at least three opposed gripping components that each define an outer surface and an inner surface, wherein each outer surface defines one or more protruding surfaces with each protruding surface defining a lower ramp section and a second abutting portion that is substantially flat, and wherein the inner surfaces define a central bore; and (c) at least three actuator assemblies, each of which is operatively configured to radially move one of the at least three opposed gripping components between a first position and a second position and to generate a clamping force in the second position, wherein the first position is radially outward and upward relative to the second position with the lower ramp section positioned above or upon the upper ramp section, wherein, in the first position, each of the at least three opposed gripping components is positioned at a non-parallel angle relative to a central axis of the central bore, and wherein, in the second position, the first abutting portion abuts the second abutting portion so that the inner surface of each of the at least three opposed gripping components is positioned substantially parallel to the central axis and the at least three opposed gripping components are configured to apply the clamping force generated by each of the at least three actuator assemblies to grip a portion of an outer surface of the tubular extending through the aperture of the rotary table and that is positioned within the central bore.

2. The slips apparatus of claim 1, wherein in the first position, an upper portion of the at least three opposed gripping components are positioned a first distance from the central axis and a lower portion of the at least three opposed gripping components are positioned a second distance from the central axis, wherein the first distance is greater than the second distance.

3. The slips apparatus of claim 1, wherein in the second position, an upper portion of the at least three opposed gripping components are positioned substantially the same distance from the central axis as a lower portion of the at least three opposed gripping components.

4. The slips apparatus of claim 1, wherein each inner surface of the at least three opposed gripping components each further comprise a die set that is configured to grip the outer surface of the tubular.

5. The slips apparatus of claim 1, further comprising at least three cam assemblies, each cam assembly comprising a first cam member that is defined on the inner non-gripping surface of one of the at least three non-gripping components and a second cam member that is defined on the outer surface of one of the at least three gripping components, wherein each cam assembly is configured to guide one of the at least three gripping components between the first position and the second position.

6. The slips apparatus of claim 5, wherein the first cam member defines a channel that is configured to receive and to slidingly guide the second cam member as the at least three opposed gripping components move between the first position and the second position.

7. The slips apparatus of claim 5, wherein the second cam member defines a channel that is configured to receive and to slidingly guide the first cam member as the at least three opposed gripping components move between the first position and the second position.

8. The slips apparatus of claim 1, wherein each of the at least three actuator assemblies comprises an actuator that is directly and pivotably connected at a first end to an associated non-gripping component and at a second end to an associated gripping component.

9. The slips apparatus of claim 8, wherein the first end of the actuator comprises a pivotable connection member that has at least two degrees of freedom.

10. The slips apparatus of claim 1, wherein at least one of the protruding surfaces of each of at least three opposed non-gripping components defines an actuator assembly channel that is configured to receive one or more portions of an associated actuator assembly as the at least three opposed gripping components move between the first position and the second position.

11. The slips apparatus of claim 1, wherein the at least three actuator assemblies are hydraulically powered.

* * * * *